US006964252B2

(12) United States Patent
Klotz

(10) Patent No.: US 6,964,252 B2
(45) Date of Patent: Nov. 15, 2005

(54) VALVE LIFTER FOR INTERNAL COMBUSTION ENGINE

(75) Inventor: James R Klotz, Clinton Township, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/738,850

(22) Filed: Dec. 17, 2003

(65) Prior Publication Data

US 2005/0061281 A1 Mar. 24, 2005

Related U.S. Application Data

(60) Provisional application No. 60/504,765, filed on Sep. 22, 2003.

(51) Int. Cl.[7] ..... F01L 1/14

(52) U.S. Cl. ..... 123/90.48; 123/90.52; 123/90.55; 123/90.2; 123/90.16; 74/569; 74/325; 74/329; 74/406; 403/109.2; 403/106

(58) Field of Search ..... 123/90.48–90.57, 123/90.16, 90.2, 90.31, 90.35, 90.15; 74/569; 403/109.2, 106, 110

(56) References Cited

U.S. PATENT DOCUMENTS

| | | | | | |
|---|---|---|---|---|---|
| 4,141,333 | A | * | 2/1979 | Gilbert | 123/198 F |
| 4,411,229 | A | * | 10/1983 | Curtis et al. | 123/198 F |
| 5,347,964 | A | | 9/1994 | Reguiero | 123/90.22 |
| 5,357,916 | A | | 10/1994 | Matterazzo | 123/90.16 |
| 5,402,756 | A | * | 4/1995 | Bohme et al. | 123/90.16 |
| 5,445,119 | A | | 8/1995 | Regueiro | 123/90.48 |
| 5,555,861 | A | * | 9/1996 | Mayr et al. | 123/90.16 |
| 5,570,665 | A | | 11/1996 | Regueiro | 123/90.27 |
| 5,577,470 | A | | 11/1996 | Leydorf, Jr. et al. | 123/90.36 |
| 5,626,110 | A | | 5/1997 | Regueiro | 123/90.22 |
| 5,638,783 | A | | 6/1997 | Regueiro | 123/90.22 |
| 5,645,023 | A | | 7/1997 | Regueiro | 123/90.27 |
| 5,673,660 | A | | 10/1997 | Regueiro | 123/90.27 |
| 5,704,319 | A | * | 1/1998 | Engelhardt et al. | 123/90.55 |
| 5,765,515 | A | | 6/1998 | Letsche | 123/90.12 |
| 5,809,950 | A | | 9/1998 | Letsche et al. | 123/90.12 |
| 5,809,956 | A | | 9/1998 | Regueiro | 123/90.27 |
| 5,921,209 | A | | 7/1999 | Regueiro | 123/90.22 |
| 5,921,210 | A | | 7/1999 | Regueiro | 123/90.22 |
| 6,164,255 | A | * | 12/2000 | Maas et al. | 123/90.16 |
| 6,318,324 | B1 | | 11/2001 | Koeroghlian et al. | 123/90.55 |
| 6,418,904 | B2 | * | 7/2002 | Hannon et al. | 123/198 F |
| 6,435,150 | B1 | | 8/2002 | Loughlin et al. | 123/90.48 |
| 6,505,589 | B1 | | 1/2003 | Hayman et al. | 123/90.23 |
| 6,505,591 | B1 | | 1/2003 | Hayman et al. | 123/90.39 |
| 6,505,592 | B1 | | 1/2003 | Hayman et al. | 123/90.61 |
| 6,568,365 | B2 | * | 5/2003 | Hannon et al. | 123/198 F |
| 6,732,687 | B2 | * | 5/2004 | Djordjevic | 123/90.16 |

* cited by examiner

*Primary Examiner*—Thomas Denion
*Assistant Examiner*—Kyle M. Riddle
(74) *Attorney, Agent, or Firm*—Thomas A. Jurecko

(57) ABSTRACT

A valve lifter is disclosed comprising a lifter housing having a receiver, a switch retainer having at least one bore, and a key disposed in the at least one bore. The key is movable into the receiver to lock the switch retainer against movement relative to the lifter housing.

15 Claims, 7 Drawing Sheets

VALVE LIFTER FOR INTERNAL COMBUSTION ENGINE

RELATED APPLICATION(S)

This application claims the benefit of U.S. Provisional Patent Application Ser. No. 60/504,765, filed Sep. 22, 2003.

TECHNICAL FIELD OF THE INVENTION

This invention relates generally to internal combustion engines for motor vehicles, and relates more particularly to a valve lifter for an internal combustion engine.

BACKGROUND OF THE INVENTION

In an internal combustion engine, the tappet is a well-known device and is also commonly referred to as a lifter or valve lifter. For examples of common forms of tappets, see "Automotive Mechanics" (10th Ed.) by William H. Crouse and Donald L. Anglin, McGraw-Hill (1993), ISBN 0-02-800943-6 at pp. 131 and 169–170; and "Power Secrets" by Smokey Yunick and Larry Schrieb, S-A Design Books (1989), ISBN 0-931472-06-7 at pp. 76–80. U.S. Pat. Nos. 5,445,119; 5,638,783; and 5,682,849 to Regueivo, and U.S. Pat. Nos. 5,860,398 and 5,947,069 to Koerner. Each of these documents is hereby incorporated by reference.

In a typical push rod engine, the lifter or tappet generally interacts directly with a rotating camshaft in the engine's valve train. That interaction begins the chain of events that converts the rotary motion of the camshaft into the reciprocating motion of the engine's intake and exhaust valves. The amount of horsepower generated by an engine is related to how efficiently the valve train operates, and thus adjustments to the valve train may have a significant impact on increasing horsepower. In general, the more efficiently air enters and combusted gas exits an engine, as controlled by the opening and closing of the intake and exhaust valves, the more horsepower the engine will produce. "Lifting," or opening the valves as high and as fast as possible, and closing the valves as fast as possible, is necessary to obtain efficient air and gas flow, and to achieve optimum horsepower. "High lift" is generally obtained by designing a camshaft having aggressive cam lobes with steep flank angles. Consequently, in high-performance applications, a tappet must be able to reliably negotiate the contour of an aggressive cam lobe at extremely high rpm's. In addition, the tappet must be durable and capable of withstanding extreme frictional forces and high valve spring pressures.

Push rod-type internal combustion engines typically use one of four types of tappets or lifters: the flat mechanical tappet, the mushroom tappet, the roller tappet, or the hydraulic tappet. The single piece, flat mechanical tappet is inexpensive, simple to produce, and reliable in stock environments. The mushroom tappet was developed in an effort to address some of the limitations of the standard mechanical tappet, particularly for use with aggressive camshaft designs. The mushroom tappet uses a foot with a larger diameter than the body of the tappet, which allows it to more easily negotiate the steeper flank angles of aggressively designed cam lobes. The roller tappet was developed in large part to overcome the many disadvantages of the mechanical tappet. Roller tappets reduce friction between the cam lobe and lifter foot, thereby reducing lubrication requirements. Thus, roller tappets are desirable in high performance applications, as they can maintain valve train stability at high rpm's and aggressive camshaft designs. Hydraulic lifters have several advantages over both mechanical lifters and roller lifters. Hydraulic lifters automatically compensate for any clearance changes caused by temperature variation or wear. Thus, they should never need adjustment. Also because there is no clearance between the lifter foot and the cam lobe, hydraulic lifters are extremely quiet while in operation when compared to both mechanical or solid lifters. Mechanical or roller lifters need to have some clearance or "lash" between the lifter foot and the cam lobe to act as a cushion to allow for any tolerance changes due to thermal expansion or contraction encountered during repeated engine cycles.

SUMMARY OF THE INVENTION

One aspect of the present invention is a valve lifter comprising a lifter housing having a receiver, a switch retainer having at least one bore, and a key disposed in the at least one bore. The key is movable into the receiver to lock the switch retainer against movement relative to the lifter housing.

Accordingly, it is an object of the present invention to provide a lifter of the type described above that is relatively compact.

Another object of the present invention is to provide a lifter of the type described above that is relatively simple and inexpensive to manufacture.

These and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
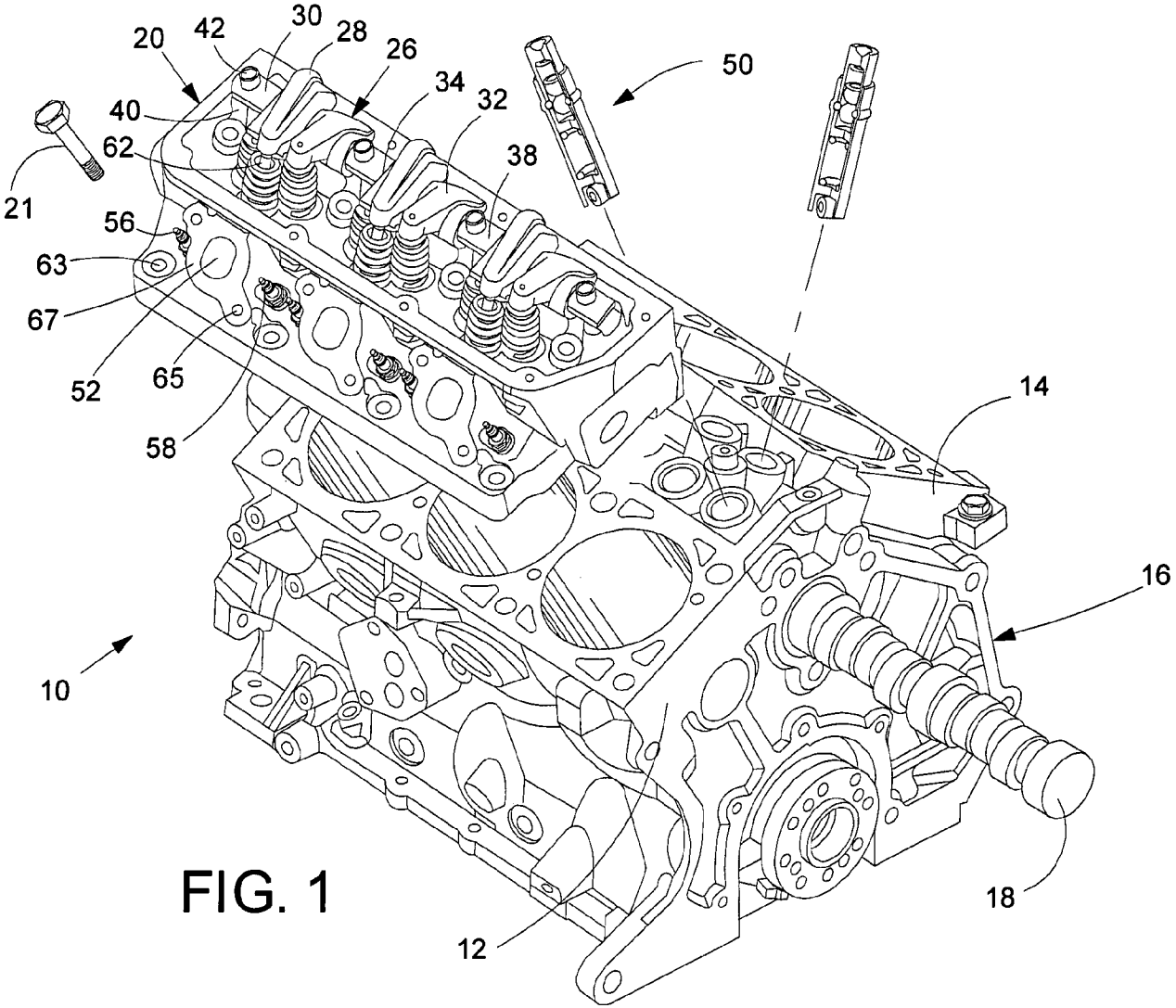
FIG. 1 is an exploded perspective view of an internal combustion engine according to the present invention.

FIG. 1 shows one embodiment 10 of an internal combustion engine according to the present invention. The engine 10 is preferably a 3.0 to 3.8 liter displacement, and most preferably a 3.3 liter displacement, motor vehicle engine having two banks 12 and 14 of three cylinders arranged in a 60 degree V shape in a block 16. A camshaft 18 is journaled in the block 16, and a cylinder head assembly 20 is connected to each bank of the block by bolts 21. The cylinder head assembly 20 includes a valve train having intake rocker assemblies 26 and exhaust rockers 28 rotatably mounted on a rocker shaft 30. The intake rocker assemblies 26 each include a pair of intake rockers 32 and 34 joined by a web for additional stiffness to inhibit twisting. The rockers are spaced apart by retainers 38, which in turn are mounted to the rocker shaft 30 and to cylinder head pedestals 40 by fasteners 42. An intake push rod and an exhaust push rod actuated by the camshaft 18 straddle an intake passage at each cylinder, and cooperate with valve lifters 50 for actuation of the rockers 32/34 and 28, respectively.

A water jacket circumvents exhaust ports 52 and the exhaust valve guides to cool the cylinder head assembly 20. Each cylinder is also preferably provided with dual spark plugs 56 and 58 that may be used for timed ignition, although it should be understood that the engine 10 may be provided with a single spark plug per cylinder. Each exhaust rocker 28 is disposed within a pocket of a corresponding intake rocker assembly 26, and extends into engagement with an exhaust valve 62. Head bolt holes 63 are provided in the cast cylinder head for the bolts 21, and tapped holes 65 are provided on surfaces 67 for mounting an exhaust manifold (not shown). Further details of the engine 10 are set forth in U.S. patent application Ser. No. 10/245,970 entitled Internal Combustion Engine Having Three Valves Per Cylinder, which is hereby incorporated by reference.

Figure 2:
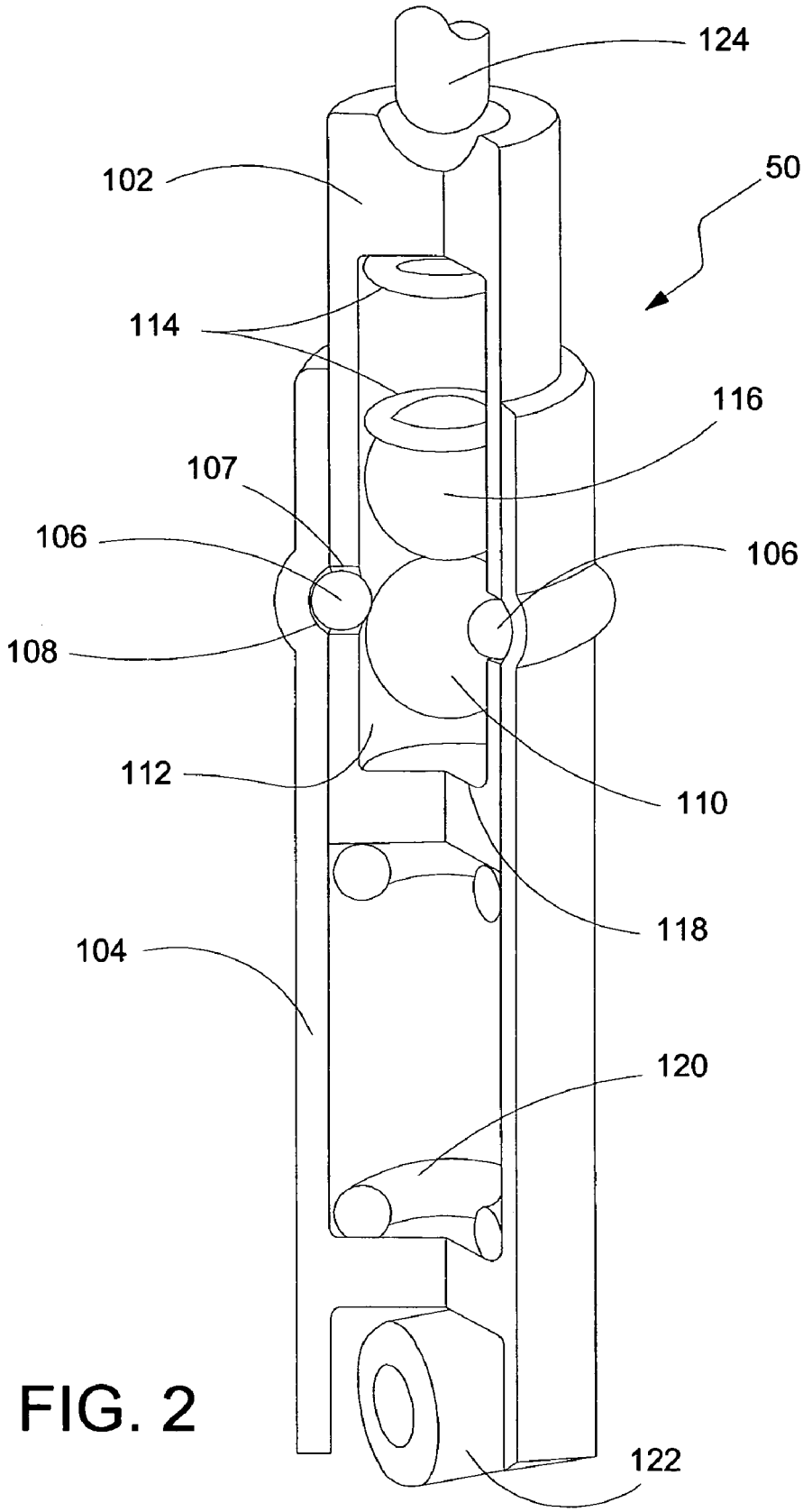
FIG. 2 is a partially cut away perspective view of a valve lifter for the internal combustion engine in a first position.

FIG. 2 shows the valve lifter 50 in a locked, high lift mode. The valve lifter 50 includes a switch retainer 102 slidably received in a lifter housing assembly 104. In the high lift mode, the switch retainer 102 is secured against movement relative to the lifter housing assembly 104 by a key such as a plurality of locking balls 106. In an embodiment, the locking balls 106 are laterally displaceable through respective bores 107 in the switch retainer and into selective engagement with a receiver such as a drive groove 108 formed in a bore of the lifter housing assembly 104. A pair of main balls 110 and 116 are disposed for free rotation in a bore of the switch retainer 102. In a preferred embodiment, the locking balls 106 are biased into the drive groove 108 by the ball 110 migrating upwardly as shown under the force of hydraulic pressure developed in a space 112, as described more fully below.

Figure 3:
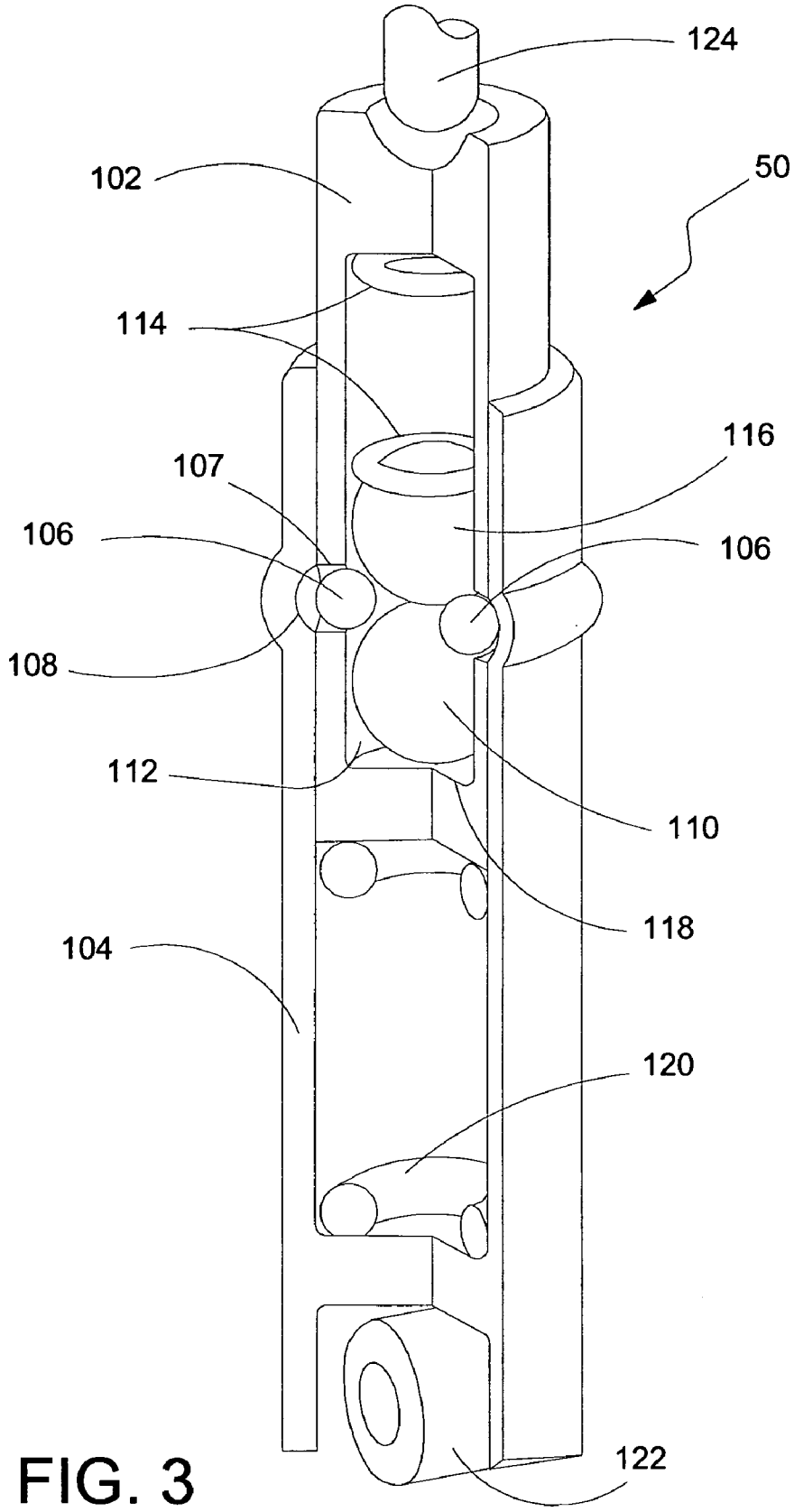
FIG. 3 is a partially cut away perspective view of the valve lifter in a second position.

FIG. 3 shows the valve lifter 50 in an intermediate position. As the hydraulic pressure is decreased in the space 112, a return spring 114 biases the main ball 110, through the second main ball 116, against a seat 118 of the switch retainer 102. At this point, the contact point between the main balls 110 and 116 is preferably generally even with the drive groove 108 in the lifter housing assembly 104. This allows the locking balls 106 to translate inwardly within their bores 107, which may be sloped slightly to facilitate this action. Once the locking balls 106 clear the drive groove 108, the switch retainer 102 is movable relative to the lifter housing assembly 104.

Figure 4:
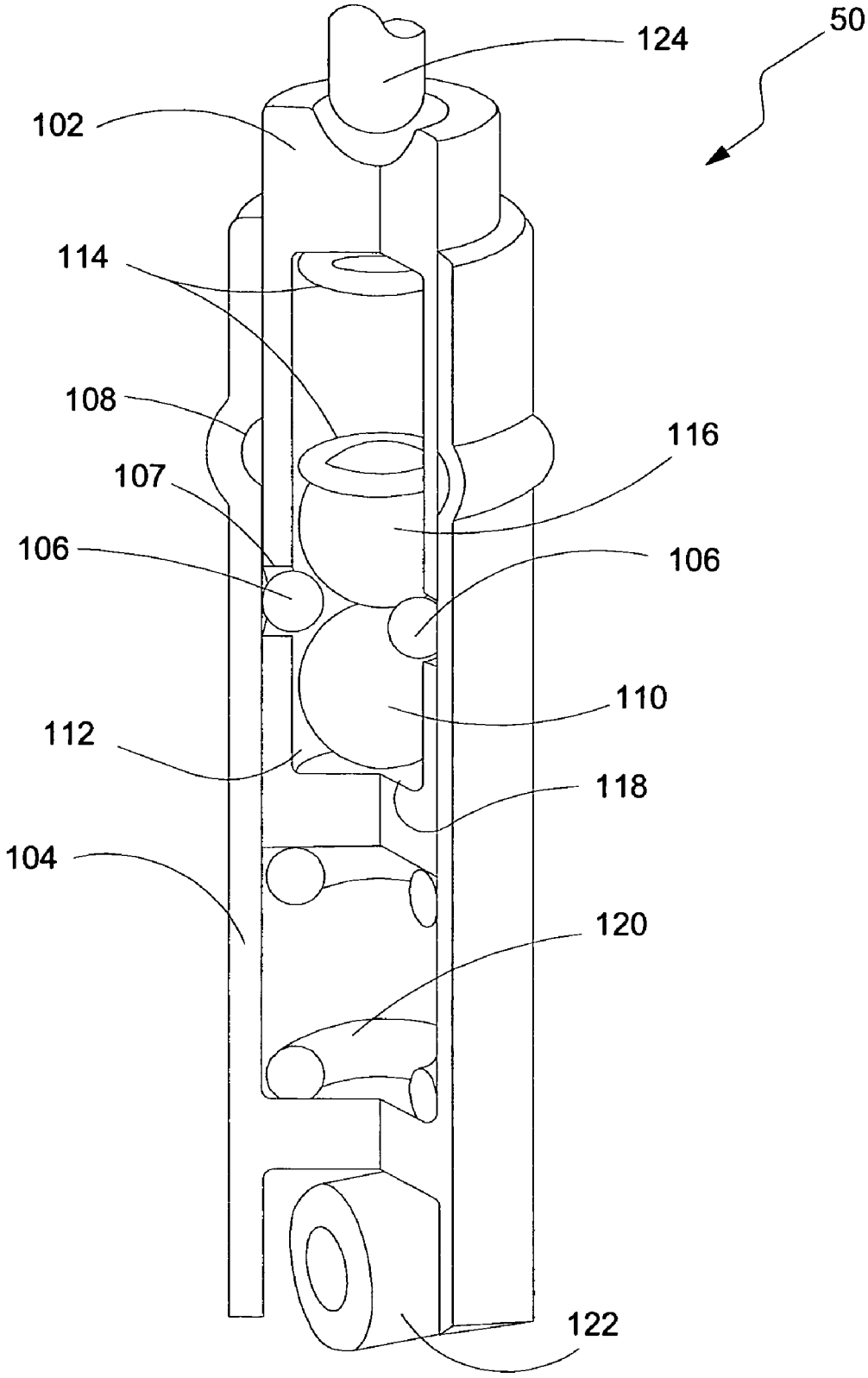
FIG. 4 is a partially cut away perspective view of the valve lifter in a third position.

FIG. 4 shows the valve lifter 50 in a low lift or solid mode wherein the switch retainer 102 compresses a progressive lost motion coil spring 120 seated in the lifter housing assembly 104. In the low lift mode, a cam follower such as a roller 122 drives the switch retainer 102, through the lifter housing assembly 104 and the coil spring 120, upwardly as shown against a push rod 124. A certain percentage of the cam rotation is absorbed by the compression of the coil spring 120, which may for instance result in relative travel between the switch retainer 102 and the lifter housing assembly 104 on the order of about 0.10 inch at lower engine revolutions per minute. At the same time, the coil geometry of the spring 120 dampens any pulses to the valve train, and the valve seating event.

Figure 5:
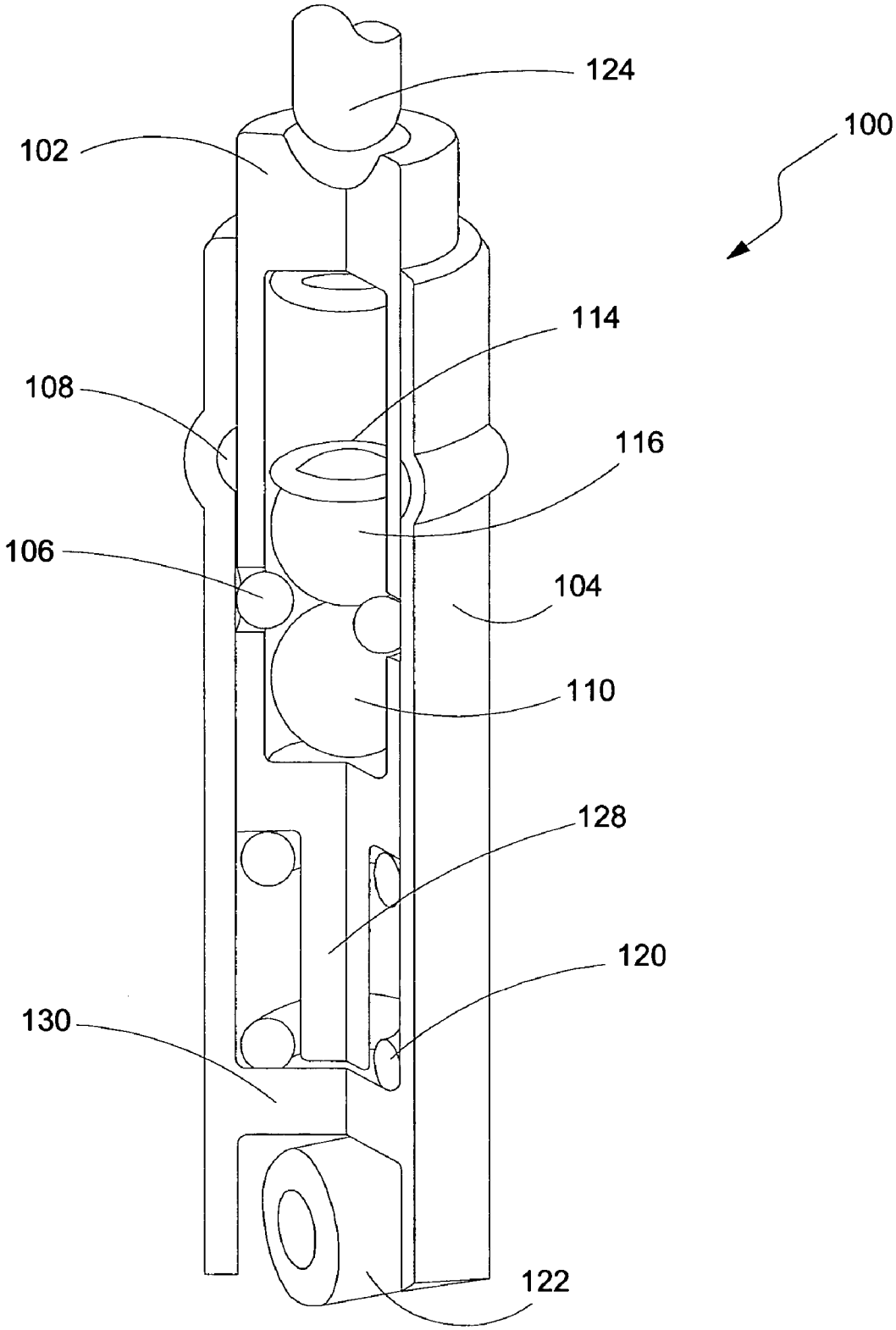
FIG. 5 is a partially cut away perspective view of an alternative embodiment of the valve lifter.

FIG. 5 shows an alternative embodiment 100 of the valve lifter in a low lift mode. In this embodiment, the switch retainer 102 includes a column 128 that descends within the coil spring 120. In the low lift mode as shown, the column 128 engages a support 130 of the lifter housing assembly 104. The push rod 124 is thus driven by the cam roller 122 through the support 130 and the column 128 of the lifter housing assembly 104. This transfer of energy is relatively smooth due to the relatively short distance traveled by the column 128 to contact surface 130, and given an appropriate selection of properties of the spring 120, a task will vary depending upon the application but that is well within the ordinary skill in the art.

Figure 6:
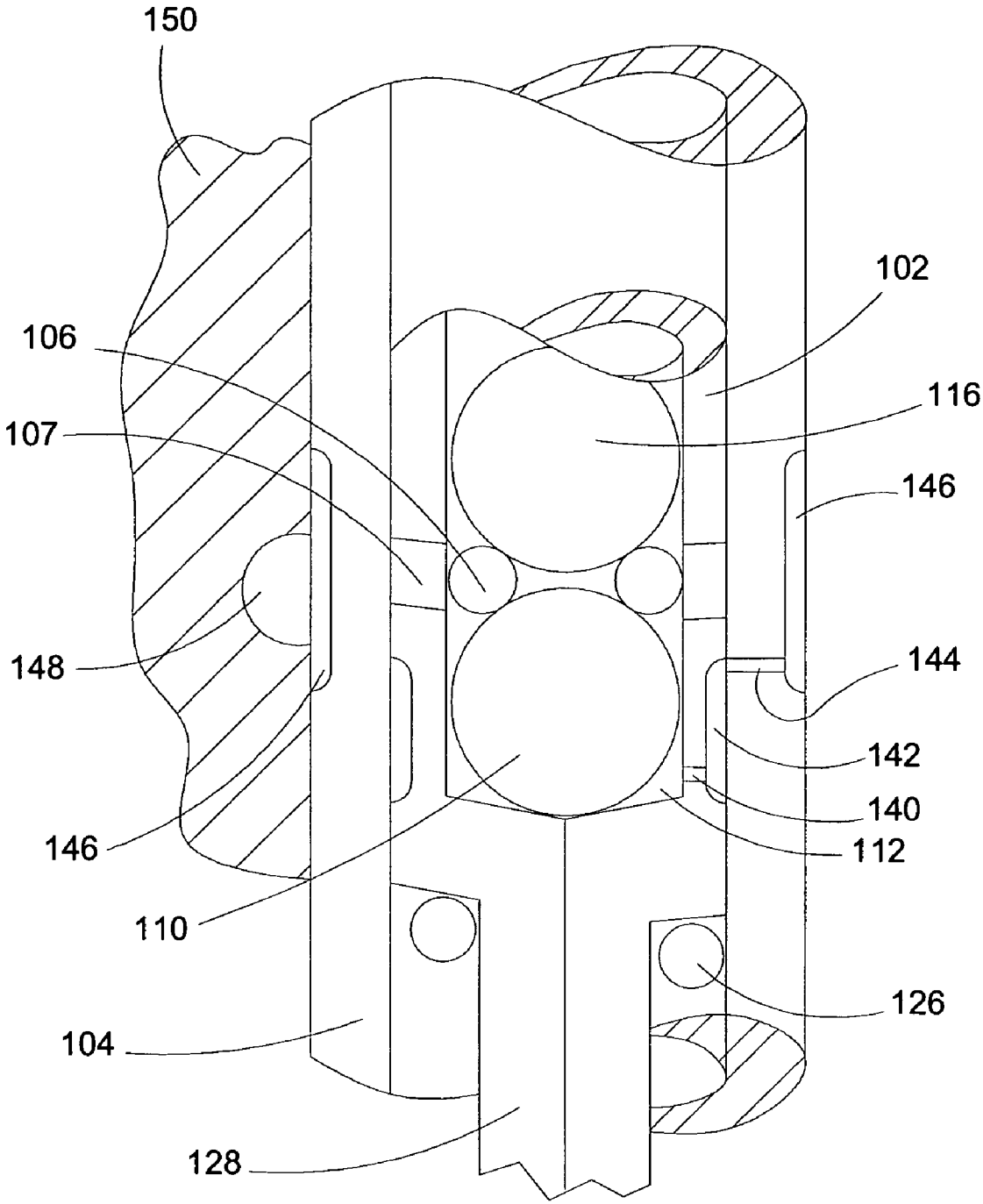
FIG. 6 is a cross-sectional view of some hydraulic features of the valve lifter.

FIG. 6 shows one system for controlling the hydraulic pressure in the space 112. A passage 140 communicating with the bore of the switch retainer 102 supplies hydraulic pressure into the space 112 below the circumference of the main ball 110. The passage 140 in turn communicates with a groove 142 formed in the outer surface of the switch retainer 102. The groove 142 is designed wide enough so that regardless of the position of the switch retainer 102 as it reciprocates within the lifter housing assembly 104, the groove 142 will always communicate with a passage 144 extending through the lifter housing assembly. The passage 144 in turn communicates with a groove 146 formed in the outer surface of the lifter housing assembly 104. The groove 146 is designed wide enough so that regardless of the position of the lifter housing assembly 104 as it reciprocates within an engine block 150, the groove 146 will remain in communication with an actuator supply passage 148 in the engine block. While the system shown in FIG. 6 includes the column 128, it should be appreciated that the idea is equally applicable to the valve lifter 50 shown in FIGS. 2 through 4.

Figure 7:
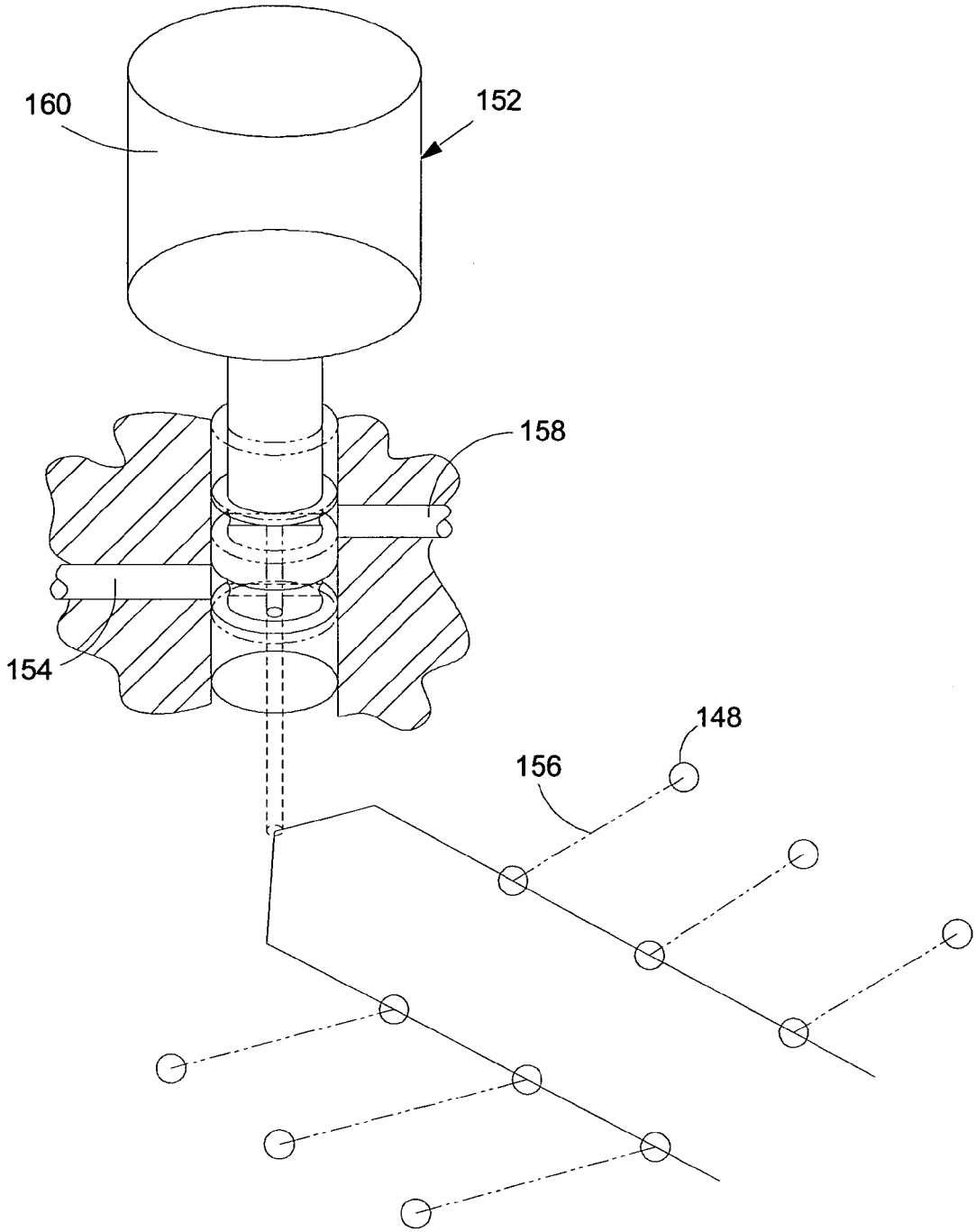
FIG. 7 is a schematic view of a hydraulic circuit for the valve lifters.

FIG. 7 shows a pulse activated spool switch valve 152 for controlling the flow of hydraulic pressure from a supply passage 154 toward individual circuits 156. A distinct circuit 156 is preferably provided for each cylinder of the engine in order to synchronize the position of all of the valve lifters. Each of the circuits 156 communicates with the supply hole 148 for each valve lifter. To deactivate the valve lifters, the spool switch valve 152 shifts to open communication with a vent passage 158, which depressurizes the space 112 behind the lower main ball 110. The spool switch valve 152 preferably migrates from the supply passage 154 to the vent passage 158 with a single energy pulse from a coil 160. This provides a switching system that is relatively energy conservative because the valve is not held on or off with a continuous power demand.

The present invention thus provides a simple ball switching element that provides high valve lift for increased power, and low valve lift for better fuel economy and lower emissions. The valve lifters of the present invention are also contained in a relatively compact lifter envelope, which allows them to be more easily implemented into existing applications. While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A valve lifter comprising:

a lifter housing having a receiver;

a switch retainer having at least one bore;

a key disposed in the at least one bore, the key being movable into the receiver to lock the switch retainer against movement relative to the lifter housing;

a first main ball disposed in the switch retainer and engagable with the key;

a second main ball disposed in the switch retainer and engagable with the first main ball; and a first spring disposed in the switch retainer and adapted to bias the first main ball.

2. The valve lifter of claim 1 wherein the receiver comprises a groove.

3. The valve lifter of claim 1 wherein the key comprises a locking ball.

4. The valve lifter of claim 1 wherein the key is movable in response to hydraulic pressure.

5. The valve lifter of claim 1 wherein the first main ball is subject to hydraulic pressure and engagable with the key in response thereto.

6. The valve lifter of claim 1 wherein the switch retainer is locked in a high lift mode.

7. The valve lifter of claim 1 further comprising a column extending from the switch retainer and engagable with the lifter housing.

8. A valve lifter for an internal combustion engine, the valve lifter comprising:

a lifter housing having a groove;

a switch retainer slidable relative to the lifter housing, the switch retainer having at least one bore;

a locking ball disposed in the at least one bore, the locking ball being movable into the groove to lock the switch retainer against movement relative to the lifter housing;

a first main ball disposed in the switch retainer and engagable with the locking ball; and a second main ball disposed in the switch retainer and engagable with the first main ball.

9. The valve lifter of claim 8 wherein the locking ball is movable in response to hydraulic pressure.

10. The valve lifter of claim 8 wherein the first main ball is subject to hydraulic pressure and engagable with the locking ball in response thereto.

11. The valve lifter of claim 8 wherein the switch retainer is locked in a high lift mode.

12. The valve lifter of claim 8 further comprising a first spring disposed in the switch retainer and adapted to bias the first main ball.

13. The valve lifter of claim 8 further comprising a spring engaged with the lifter housing and adapted to bias the switch retainer away from the lifter housing.

14. The valve lifter of claim 8 further comprising a column extending from the switch retainer and engagable with the lifter housing.

15. A valve lifter for an internal combustion engine, the valve lifter comprising:

a lifter housing having a groove;

a switch retainer slidable relative to the lifter housing, the switch retainer having at least one bore;

a locking ball disposed in the at least one bore, the locking ball being movable into the groove to lock the switch retainer against movement relative to the lifter housing;

a first main ball disposed in the switch retainer and engagable with the locking ball in response to hydraulic pressure; and a second main ball disposed in the switch retainer and engagable with the first main ball.

* * * * *